US007434554B2

(12) United States Patent
Nagashima

(10) Patent No.: US 7,434,554 B2
(45) Date of Patent: Oct. 14, 2008

(54) CONTROLLER FOR VANE-TYPE VARIABLE VALVE TIMING ADJUSTING MECHANISM

(75) Inventor: Wataru Nagashima, Kariya (JP)

(73) Assignee: DENSO CORPORATION (JP)

( * ) Notice: Subject to any disclaimer, the term of this patent is extended or adjusted under 35 U.S.C. 154(b) by 0 days.

(21) Appl. No.: 11/797,503

(22) Filed: May 3, 2007

(65) Prior Publication Data

US 2007/0266976 A1 Nov. 22, 2007

(30) Foreign Application Priority Data

May 19, 2006 (JP) ..... 2006-140891

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,330,870 B1 12/2001 Inoue et al.
6,453,859 B1 9/2002 Smith et al.
6,763,791 B2 7/2004 Gardner et al.
2004/0040525 A1 * 3/2004 Simpson ..... 123/90.17

* cited by examiner

*Primary Examiner*—Zelalem Eshete
(74) *Attorney, Agent, or Firm*—Nixon & Vanderhye PC

(57) ABSTRACT

In a vane-type variable valve timing adjusting mechanism (VCT), an OCV target current is set to the holding current to hold an actual advance amount in close proximity to the target advance amount during the execution of the holding control. In the holding control, when the deviation between the actual and target advance amounts reaches beyond the holding control region (determination threshold value) and enters into the micro displacement control region, the micro displacement control (pulse-current application control) is started, and the pulse current is applied to the hydraulic control valve to use advantages of pulse current to drive the VCT in the direction of the target advance amount. Thus, when the actual advance amount comes back into close proximity to the target advance amount, the holding control is restarted, and the OCV target current is set to the holding current to hold the actual advance amount at the target advance amount.

23 Claims, 10 Drawing Sheets

CONTROLLER FOR VANE-TYPE VARIABLE VALVE TIMING ADJUSTING MECHANISM

CROSS REFERENCE TO RELATED APPLICATION

This application is based on Japanese Patent Application No. 2006-140891 filed on May 19, 2006, the disclosure of which is incorporated herein by reference.

FIELD OF THE INVENTION

The present invention relates to a controller for a vane-type variable valve timing adjusting mechanism to make an actual displacement angle equal to a target displacement angle, in which a hydraulic control valve controls a hydraulic pressure in an advance hydraulic chamber and a hydraulic pressure in a retard hydraulic chamber in such a manner as to drive the vane-type variable valve timing adjusting mechanism in the direction of the target displacement angle.

BACKGROUND OF THE INVENTION

A vane-type variable valve timing adjusting mechanism is, as shown in JP2001-159330A (U.S. Pat. No. 6,330,870B1), adapted in such a manner that a housing rotating in a timed relation to a crank shaft of an engine is disposed coaxially with a vane rotor connected to a cam shaft of an intake valve (or exhaust valve) and a plurality of vane-accommodating chambers formed in the housing respectively are divided into an advance hydraulic chamber and a retard hydraulic chamber by vanes (blade portions) at the outer periphery of the vane rotor. In addition, the hydraulic pressure in each hydraulic chamber is designed to be controlled by a hydraulic control valve to rotate the vane rotor relative to the housing, so that a displacement angle of the cam shaft (cam shaft phase) to the crankshaft is varied to variably control valve timing.

In the vane-type variable valve timing adjusting mechanism (hereinafter referred to as "VCT"), typically, the VCT shows a non-linear response characteristic to the electric current applied to a hydraulic control valve (hereinafter referred to as "OCV current"), in which a region where the response becomes slow exists around a point at which a holding current is applied for holding the VCT on a certain position. In this region, even if the OCV current is feedback-controlled in accordance with the deviation between the target displacement angle and the actual displacement angle, the movement of the VCT is still slow and the VCT cannot promptly respond or be driven in the direction of the target displacement angle.

When the feedback gain is excessively increased as a countermeasure, the overshooting occurs to deteriorate a convergent characteristic of an actual displacement angle to a target displacement angle, thereby producing the problem of deteriorating combustion of an engine or the like.

SUMMARY OF THE INVENTION

The present invention has been made in view of such circumstances, and an object of the present invention is to provide a controller for a vane-type variable valve timing adjusting mechanism which can drive the VCT with a faster response than conventional without the occurrence of overshooting.

In order to achieve the above object, a controller for a vane-type variable valve timing adjusting mechanism (VCT), in which each of a plurality of vane accommodating chambers formed in a housing of the VCT is divided into an advance hydraulic chamber and a retard hydraulic chamber by a vane, is provided with a hydraulic control valve for controlling a hydraulic pressure in the advance hydraulic chamber and a hydraulic pressure in the retard hydraulic chamber, and control means for controlling an electric current applied to the hydraulic control valve in accordance with a deviation between a target displacement angle and an actual displacement angle of the VCT, wherein the control means performs pulse application control to apply pulse current to the hydraulic control valve to drive the VCT in a direction of the target displacement angle.

Accordingly, when the pulse current is applied to the hydraulic control valve, if a relative largely pulse current flows, the application time is very short. Hence, a VCT displacement amount (advance amount/retard amount) becomes minute. In consequence, the application of the pulse current through the hydraulic control valve makes it possible to drive the VCT with a faster response than conventional without the occurrence of overshooting.

DETAILED DESCRIPTION OF THE EMBODIMENTS

Figure 1:
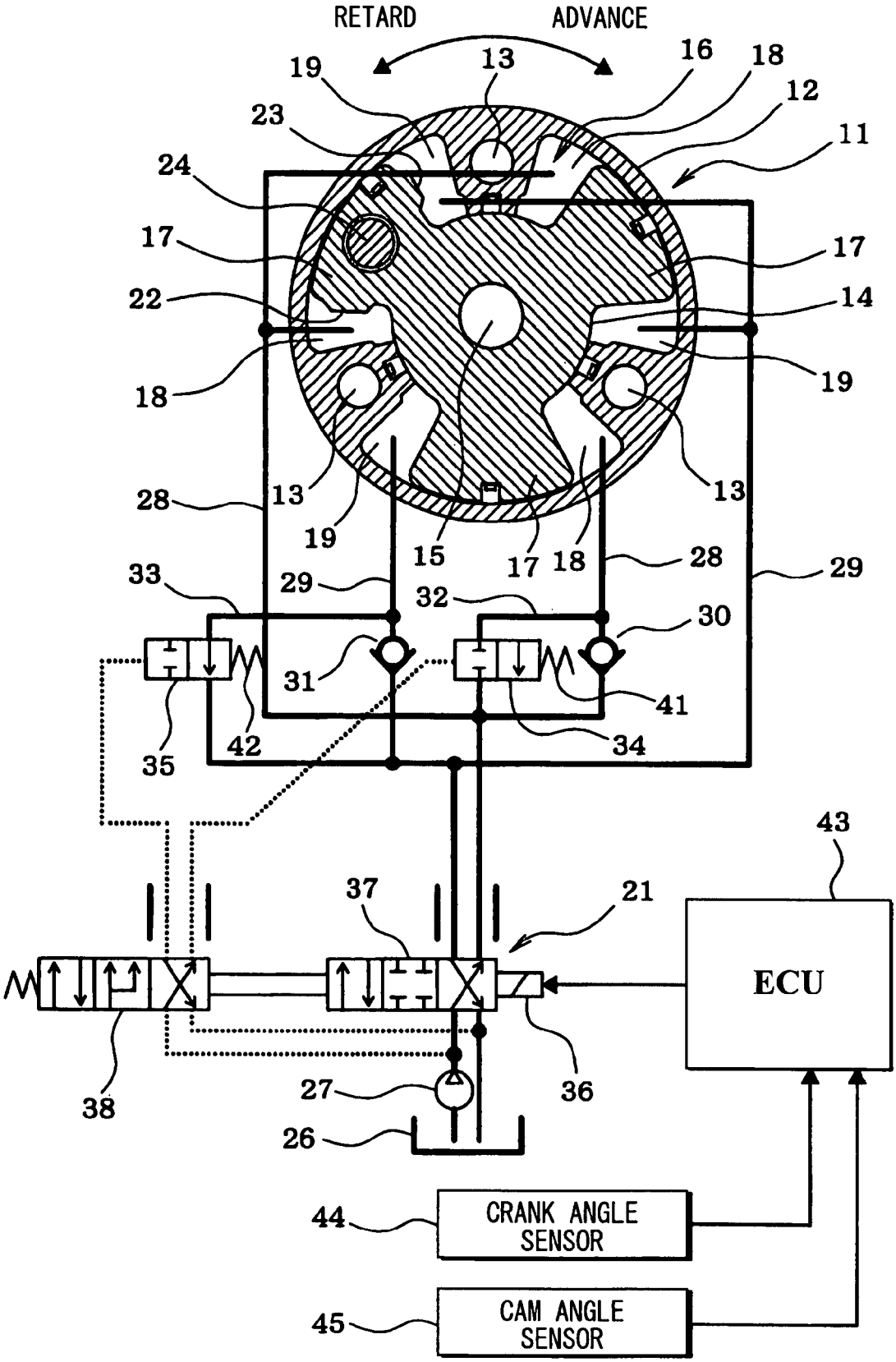
FIG. 1 is a schematic diagram showing a variable valve timing adjusting mechanism and a hydraulic control circuit thereof in an embodiment of the present invention.

Hereinafter, embodiments for a best mode of carrying out the present invention will be described.

First, a structure of a vane-type variable valve timing adjusting mechanism 11 will be explained with reference to FIG. 1. A housing 12 of the variable valve timing adjusting mechanism 11 is clamped and fixed to a sprocket rotatably supported at an outer periphery of a cam shaft on an intake side or an exhaust side (not shown) by bolts 13. In consequence, rotation of a crankshaft for an engine is transmitted through a timing chain to the sprocket and the housing 12 and the sprocket and the housing 12 rotate in a timed relation to the crankshaft. A vane rotor 14 is accommodated inside the housing 12 so as to rotate relative thereto and is clamped and fixed to one end of the camshaft by a bolt 15.

A plurality of vane accommodating chambers 16 for accommodating a plurality of vanes 17 at an outer periphery of the vane rotor 14 so as to rotate in the advance direction or the retard direction relative to the housing 12 are defined inside the housing 12 and each vane accommodating chamber 16 is divided into an advance hydraulic chamber 18 and a retard hydraulic chamber 19.

In the state where a hydraulic pressure beyond a predetermined pressure is supplied to the advance hydraulic chamber 18 and the retard hydraulic chamber 19, the vane 17 is held by the hydraulic pressures in the advance hydraulic chamber 18 and the retard hydraulic chamber 19 to transmit rotation of the housing 12 caused by rotation of the crank shaft to the vane rotor 14 through the hydraulic pressures, thereby rotating the cam shaft integrally with the vane rotor 14. During engine operating, the hydraulic pressures in the advance hydraulic chamber 18 and the retard hydraulic chamber 19 are controlled by a hydraulic control valve 21 to rotate the vane rotor 14 relative to the housing 12, thereby controlling a displacement angle of the cam shaft (cam shaft phase) to the crank shaft to vary valve timing of an intake valve (or exhaust valve).

In addition, stoppers 22 and 23 for controlling a relative rotational range of the vane rotor 14 to the housing 12 are formed at both side portions of any one of the vanes 17, and the maximum retard position and the maximum advance position of the displacement angle of the cam shaft (cam shaft phase) are restricted by the stoppers 22 and 23. In addition, any one of the vanes 17 is provided with a lock pin 24 disposed therein for locking a displacement angle of the cam shaft in a certain lock position at engine stopping or the like. This lock pin 24 is inserted into a lock hole (not shown) disposed in the housing 12, causing the displacement angle of the camshaft to be locked at a certain lock position. This lock position is set to a position suitable for engine startup (for example, a substantially intermediate position within an possible adjustment range of a displacement angle of the cam shaft).

Oil contained in an oil pan 26 (operating oil) is supplied to a hydraulic control circuit of the variable valve timing adjusting mechanism 11 through the hydraulic control valve 21 by an oil pump 27. The hydraulic control circuit includes a hydraulic supply oil passage 28 supplying oil discharged from an advance pressure port of the hydraulic control valve 21 to a plurality of advance hydraulic chambers 18 and a hydraulic supply oil passage 29 supplying oil discharged from a retard pressure port of the hydraulic control valve 21 to a plurality of retard hydraulic chambers 19.

Further, one-way valves 30 and 31 are disposed in the hydraulic supply oil passage 28 of the advance hydraulic chamber 18 and the hydraulic supply oil passage 29 of the retard hydraulic chamber 19 for preventing a reverse flow of the operating oil from the respective chambers 18 and 19. In the present embodiment, the one-way valves 30 and 31 are disposed in the hydraulic control oil passages 28 and 29 of the advance hydraulic chamber 18 and the retard hydraulic chamber 19 in the single vane accommodating chamber 16 only. The one-way valves 30 and 31 may equally be disposed in the hydraulic control oil passages 28 and 29 of the advance hydraulic chamber 18 and the retard hydraulic chamber 19 in each of a plurality of the vane accommodating chambers 16.

Drain oil passages 32 and 33 for bypassing the one-way valves 30 and 31 respectively are disposed in parallel in the hydraulic supply oil passages 28 and 29 of the respective chambers 18 and 19, and drain switching valves 34 and 35 are disposed in the drain oil passages 32 and 33 respectively. The drain switching valves 34 and 35 respectively are formed of spool valves driven in a closing direction by hydraulic pressure (pilot pressure) supplied from the hydraulic control valve 21. When the hydraulic pressure is not applied, the drain switching valves 34 and 35 are held in an opening position. When the drain switching valves 34 and 35 are opened, the drain oil passages 32 and 33 are opened, causing functions of the one-way valves 30 and 31 to be stopped. When the drain switching valves 34 and 35 are closed, the drain oil passages 32 and 33 are closed, causing functions of the one-way valves 30 and 31 to be effectively performed. Therefore, the reverse flow of the oil from the hydraulic chambers 18 and 19 is prevented, maintaining the hydraulic pressures in the hydraulic chambers 18 and 19.

The drain switching valves 34 and 35 respectively do not require electrical wiring and therefore, are downsized to be incorporated in the vane rotor 14 inside the variable valve timing adjusting mechanism 11, together with the one-way valves 30 and 31. In consequence, the drain switching valves 34 and 35 are located near the hydraulic chambers 18 and 19 respectively and are adapted to open/close the respective drain oil passages 32 and 33 near the respective hydraulic chambers 18 and 19 at advance/retard operating in good response.

On the other hand, the hydraulic control valve 21 is formed of a spool valve driven by a linear solenoid 36, where an advance/retard hydraulic control valve 37 controlling the hydraulic pressures supplied to the advance hydraulic chamber 18 and the retard hydraulic chamber 19 is integral with the a drain switching control valve 38 (hydraulic switching valve) switching the hydraulic pressure driving the drain switching valves 34 and 35 respectively. A current value (control duty) supplied to the linear solenoid 36 of the hydraulic control valve 21 is controlled by an engine control circuit (hereinafter referred to as "ECU") 43.

The ECU 43 calculates actual valve timing (actual displacement angle) of the intake valve (exhaust valve) based upon output signals of a crank angle sensor 44 and a cam angle sensor 45 and also calculates target valve timing (target displacement angle) of the intake valve (exhaust valve) based upon outputs of various sensors such as an intake pressure sensor and a water temperature sensor for detecting an engine operating condition. In addition, the ECU 43, by executing each of the routines in FIGS. 5 to 9 to be described later, controls a control current value of the hydraulic control valve 21 in the variable valve timing adjusting mechanism 11 so that the actual valve timing be equal to the target valve timing. Thereby, the hydraulic pressures in the advance hydraulic chamber 18 and the retard hydraulic chamber 19 are controlled to rotate the vane rotor 14 relative to the housing 12, causing a displacement angle of the cam shaft to be varied for making the actual valve timing equal to the target valve timing.

Figure 3:
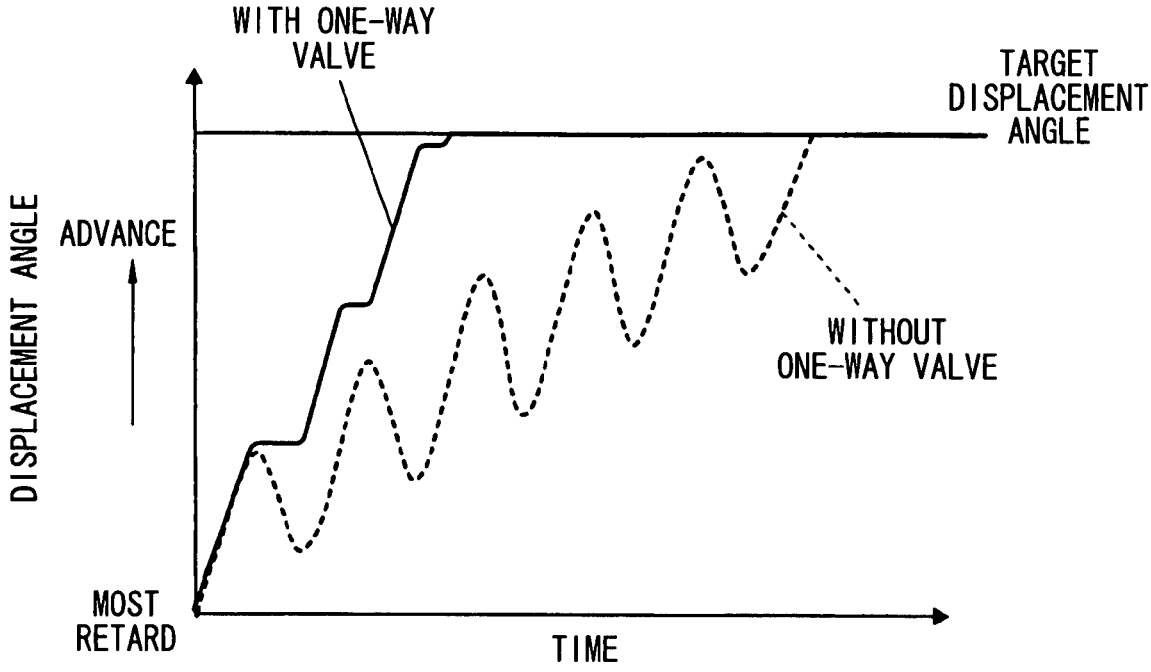
FIG. 3 is a characteristic diagram explaining a difference in VCT response rate at advance operating depending on presence/absence of a one-way valve.

Here, when the intake valve or the exhaust valve is opened/closed during engine operating, the torque fluctuation the cam shaft receives from the intake valve or the exhaust valve is transmitted to the vane rotor 14, causing the torque fluctuation in the retard direction and in the advance direction to be exerted on the vane rotor 14. In consequence, when the vane rotor 14 is subjected to the torque fluctuation in the retard direction, the operating oil in the advance hydraulic chamber 18 receives pressure pushing it out of the advance hydraulic chamber 18 and on the other hand, when the vane rotor 14 is subjected to the torque fluctuation in the advance direction, the operating oil in the retard hydraulic chamber 19 receives pressure pushing it out of the retard hydraulic chamber 19. Therefore, in a low-rotation region where a discharge hydraulic pressure of the oil pump 27 as a hydraulic supply source is low, without the one-way valves 30 and 31, even if the hydraulic pressure is designed to be supplied to the advance hydraulic chamber 18 to advance a displacement angle of the cam shaft, as shown in the dotted line in FIG. 3, the vane rotor 14 is pushed back in the retard direction due to the torque fluctuation, raising the problem that the response time until the vane rotor 14 reaches a target displacement angle is longer.

On the other hand, in the present embodiment, the one-way valves 30 and 31 are disposed in the hydraulic supply oil passage 28 of the advance hydraulic chamber 18 and the hydraulic supply oil passage 29 of the retard hydraulic chamber 19 for preventing reverse flow of the operating oil from the respective chambers 18 and 19. Further, the drain oil passage 32 and 33 for bypassing the one-way valves 30 and 31 respectively are disposed in parallel in the hydraulic supply oil passages 28 and 29 of the respective chambers 18 and 19, and drain switching valves 34 and 35 are disposed in the drain oil passages 32 and 33 respectively. As a result, as shown in FIGS. 2A, 2B and 2C, the hydraulic pressures in the chambers 18 and 19 respectively are controlled in response to a retard operation, a holding operation and an advance operation as follows.

[Retard Operation]

Figure 2A:
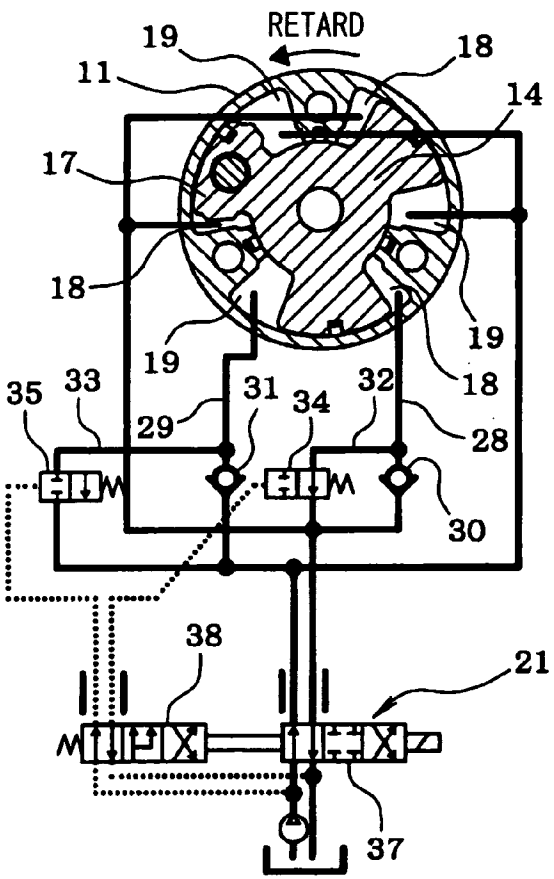
FIGS. 2A, 2B and 2C are diagrams each explaining a retard operation, a holding operation and an advance operation in the variable valve timing adjusting mechanism.
Figure 2B:
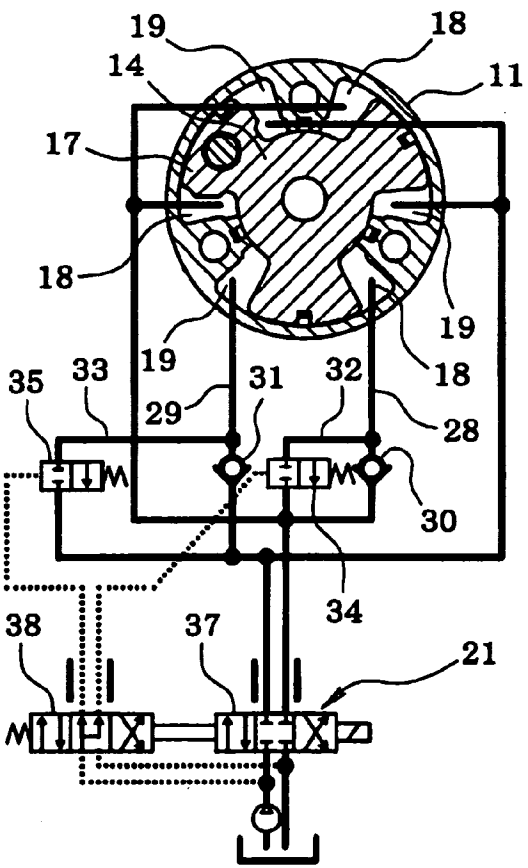
Figure 2C:
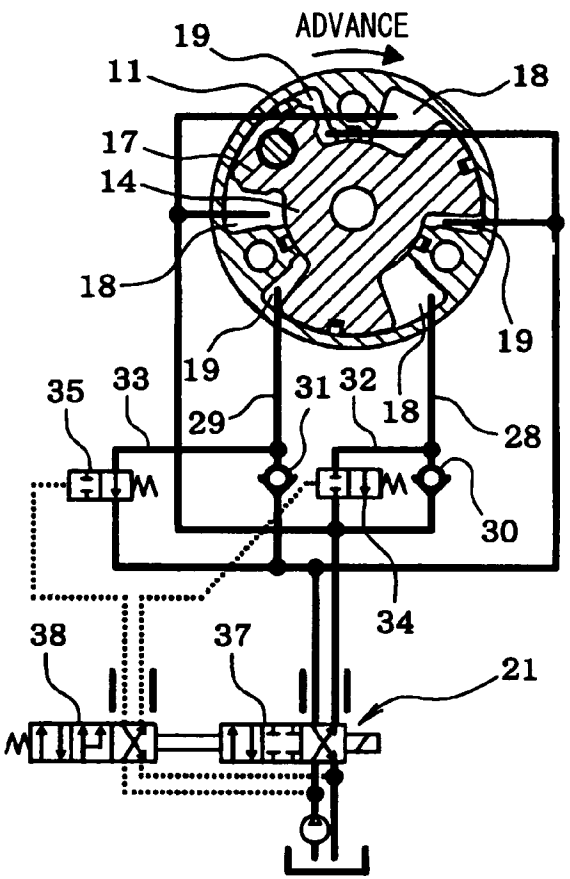

As shown in FIG. 2A, during a retard operation where the actual valve timing is retarded toward the target valve timing on the retard side, the hydraulic pressure is added to the drain switching valve 34 in the advance hydraulic chamber 18 from the hydraulic control valve 21 to open the drain switching valve 34 in the advance hydraulic chamber 18, creating the state where the one-way valve 30 in the advance hydraulic chamber 18 does not function. Further, the hydraulic supply to the drain switching valve 35 in the retard hydraulic chamber 19 is stopped to close the drain switching valve 35 in the retard hydraulic chamber 19, creating the state where the one-way valve 31 in the retard hydraulic chamber 19 functions. In consequence, even at a low hydraulic pressure, upon occurrence of the torque fluctuation in the advance direction of the vane rotor 14, the reverse flow of oil from retard hydraulic chamber 19 is prevented by the one-way valve 31, while efficiently supplying the hydraulic pressure to the retard hydraulic chamber 19, thereby improving retard response characteristic.

[Holding Operation]

As shown in FIG. 2B, during a holding operation where the actual valve timing is held to the target valve timing, the hydraulic supply to both of the drain switching valves 34 and 35 in the advance hydraulic chamber 18 and in the retard hydraulic chamber 19 is stopped to close the drain switching valves 34 and 35, creating the state where the one-way valves 30 and 31 in the advance hydraulic chamber 18 and in the retard hydraulic chamber 19 function. In this state, even if the torque fluctuations in the retard direction and in the advance direction are applied to the vane rotor 14 due to the torque fluctuations the cam shaft receives from the intake valve or the exhaust valve, the reverse flow of oil from both of the advance hydraulic chamber 18 and the retard hydraulic chamber 19 is prevented by the one-way valve 31 to prevent reduction in the hydraulic pressures holding the vane 17 from both side thereof, thereby improving holding stability.

[Advance Operation]

As shown in FIG. 2C, during an advance operation where the actual valve timing is advanced toward the target valve timing on the advance side, the hydraulic pressure from hydraulic switching valve 38 to the drain switching valve 34 in the advance hydraulic chamber 18 is applied to close the drain switching valve 34 in the advance hydraulic chamber 18, causing the state where the one-way valve 30 in the advance hydraulic chamber 18 functions. Further, the hydraulic pressure supply to the drain switching valve 35 in the retard hydraulic chamber 19 is stopped to open the drain switching valve 35 in the retard hydraulic chamber 19, creating the state where the one-way valve 31 in the retard hydraulic chamber 19 does not function. In consequence, even at a low hydraulic pressure, the reverse flow of oil from the advance hydraulic chamber 18 upon occurrence of the torque fluctuation in the retard direction of the vane rotor 14 is prevented by the one-way valve 30, while efficiently supplying the hydraulic pressure to the advance hydraulic chamber 18, thereby improving advance response characteristic.

Figure 4:
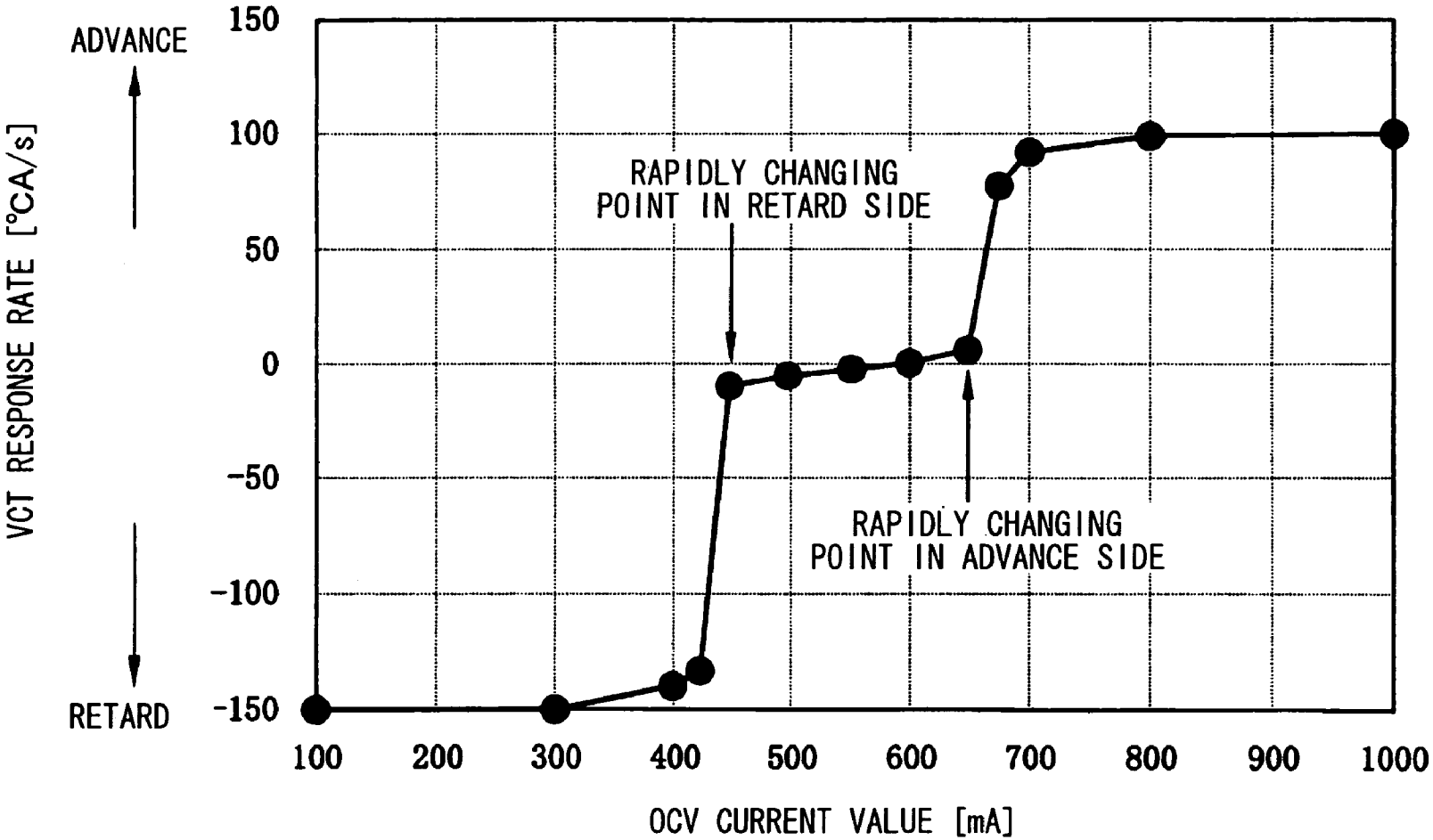
FIG. 4 is a characteristic diagram showing one example of a response characteristic of the variable valve timing adjusting mechanism with a one-way valve.

Next, the response characteristic of the variable valve timing adjusting mechanism 11 (hereinafter referred to as "VCT response characteristic") will be explained with reference to FIG. 4. FIG. 4 shows one example of a response characteristic obtained by measuring a relation between a control current value of the hydraulic control valve 21 (hereinafter, referred to as "OCV current value") and a response rate of the variable valve timing adjusting mechanism 11.

In the present embodiment, since the one-way valves 30 and 31 and the drain switching valves 34 and 35 are disposed in both the advance hydraulic chamber 18 and the retard hydraulic chamber 19, a VCT response rate does not change linearly to a change of an OCV current value and the drain switching valves 34 and 35 are switched between the open, and closed position, causing the VCT rate to rapidly change at two points. In the VCT response characteristic of FIG. 4, the rapid changing point of the VCT response on the retard side is a point where the drain switching valve 34 in the advance hydraulic chamber 18 switches from the closed position to the open position, and the rapid changing point of the VCT response on the advance side is a point where the drain switching valve 35 in the retard hydraulic chamber 19 switches from the closed position to the open position. The holding operation is made in a region where a grade of a VCT response rate change between the rapid changing point of the VCT response on the retard side and the rapid changing point of the VCT response on the advance side is small.

As shown in FIG. 4, the response characteristic of the VCT 11 to the OCV current is not linear, so that a region where the response becomes slow (between the rapid changing point of the VCT response on the retard side and the rapid changing point of the VCT response on the advance side) exists around a point at which a holding current is applied for holding the VCT 11 in a certain position. In this region, even if the OCV current is feedback-controlled in accordance with the deviation between the target displacement angle and the actual displacement angle, the movement of the VCT 11 is slow and the VCT 11 cannot be promptly driven in the direction of the target displacement angle.

When the feedback gain is excessively increased as a countermeasure, overshooting occurs to deteriorate the convergent characteristic of then actual displacement angle to the target displacement angle, thereby producing the problem of deteriorating combustion of an engine or the like.

In the present embodiment, in the region where the response characteristic of the VCT 11 to the OCV current decreases in speed (between the rapid changing point of the VTC response on the retard side and the rapid changing point of the VTC response on the advance side), for the micro displacement control to finely change the actual displacement angle of the VCT 11 (actual advance amount) at a point close to the target displacement angle (target advance amount), "pulse-current application control" is performed to apply the pulse current to the hydraulic control valve 21 to drive the VCT 11 in the direction of the target displacement angle. As a result of the application of the pulse current through the hydraulic control valve 21 in this manner, if a relative large pulse current flows, the application time is very short. Hence, the VCT displacement amount (advance amount/retard amount) becomes minute. In consequence, the application of the pulse current through the hydraulic control valve 21 makes it possible to drive the VCT 11 with a faster response than conventional without the occurrence of overshooting.

In this case, a region where the deviation between the actual displacement angle of the VCT 11 and the target displacement angle thereof is smaller than a determination threshold value for the deviation in the micro displacement control region (pulse-current application control region) is defined as the holding control region. In this holding control region, a holding current is applied to the hydraulic control valve 21 to hold the actual displacement angle of the VCT 11 at the target displacement angle. As a result, immediately after the deviation between the actual displacement angle of the VCT 11 and the target displacement angle passes beyond the holding control region and enters into the micro displacement control region (pulse-current application control region) during the holding control, pulse-current application control can be performed to decrease the deviation between the actual displacement angle of the VCT 11 and the target displacement angle thereof, resulting in improvements in the convergent characteristic and holding characteristic of the actual displacement angle with relation to the target displacement angle. It should be noted that a value learned during the holding control may be used for the holding current.

On the other hand, a region where the deviation between the actual displacement angle and the target displacement angle of the VCT 11 is larger than the determination threshold value for the deviation in the micro displacement control region (pulse-current application control region) is defined as a high-speed control region. In this high-speed control region, a feedback control and/or a feed forward control is performed on the current of the hydraulic control valve 21 in accordance with the deviation between the actual displacement angle and the target displacement angle of the VCT 11. As a result, in the transitional operation in which the target displacement angle rapidly varies largely, a large current can be continuously applied to the hydraulic control valve 21 in accordance with the deviation between the actual displacement angle and the target displacement angle, in order to drive the VCT 11 at high speeds in the direction of the target displacement angle.

Figure 5:
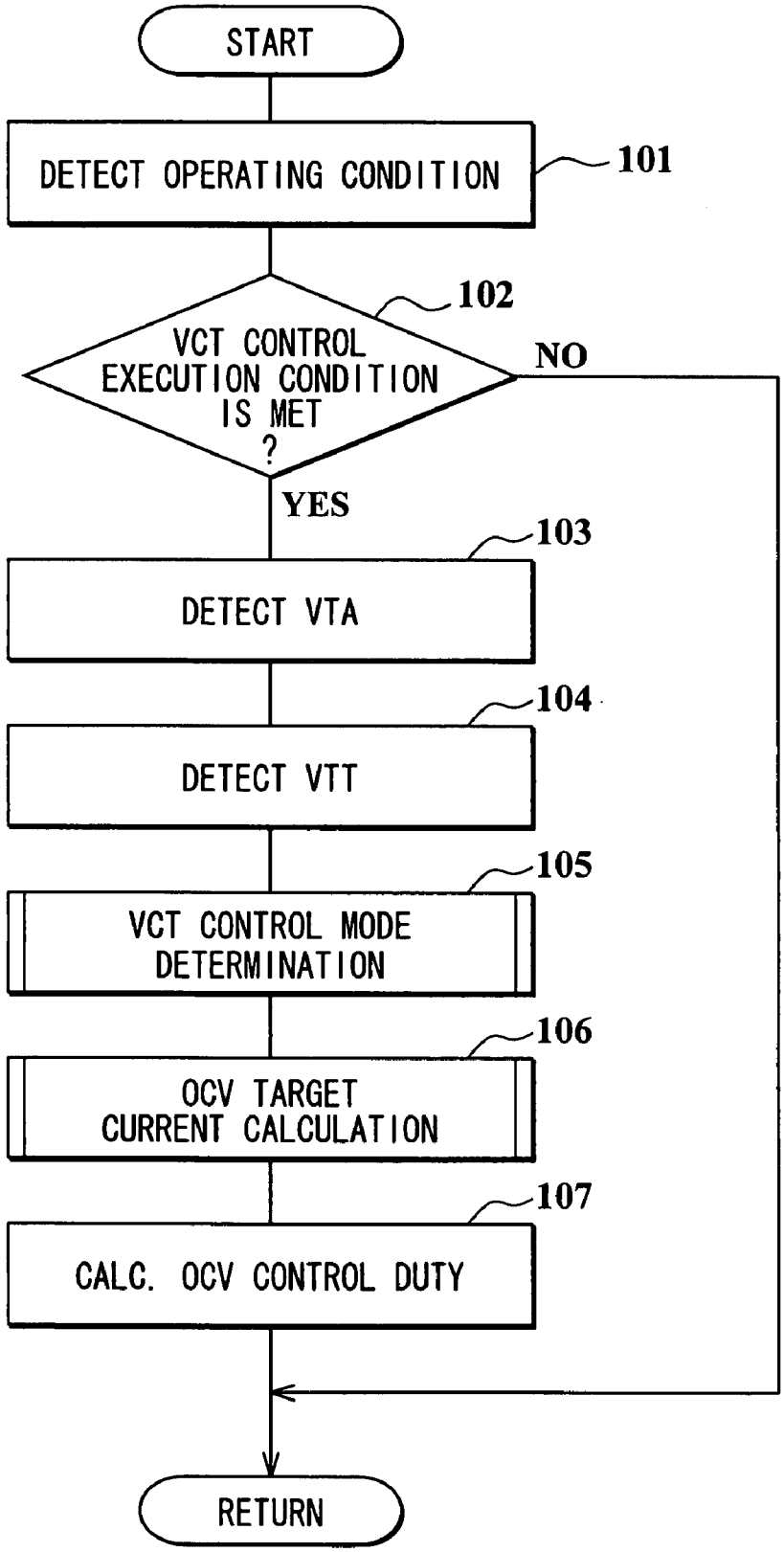
FIG. 5 is a flow chart explaining the process order of a VCT control routine.
Figure 6:
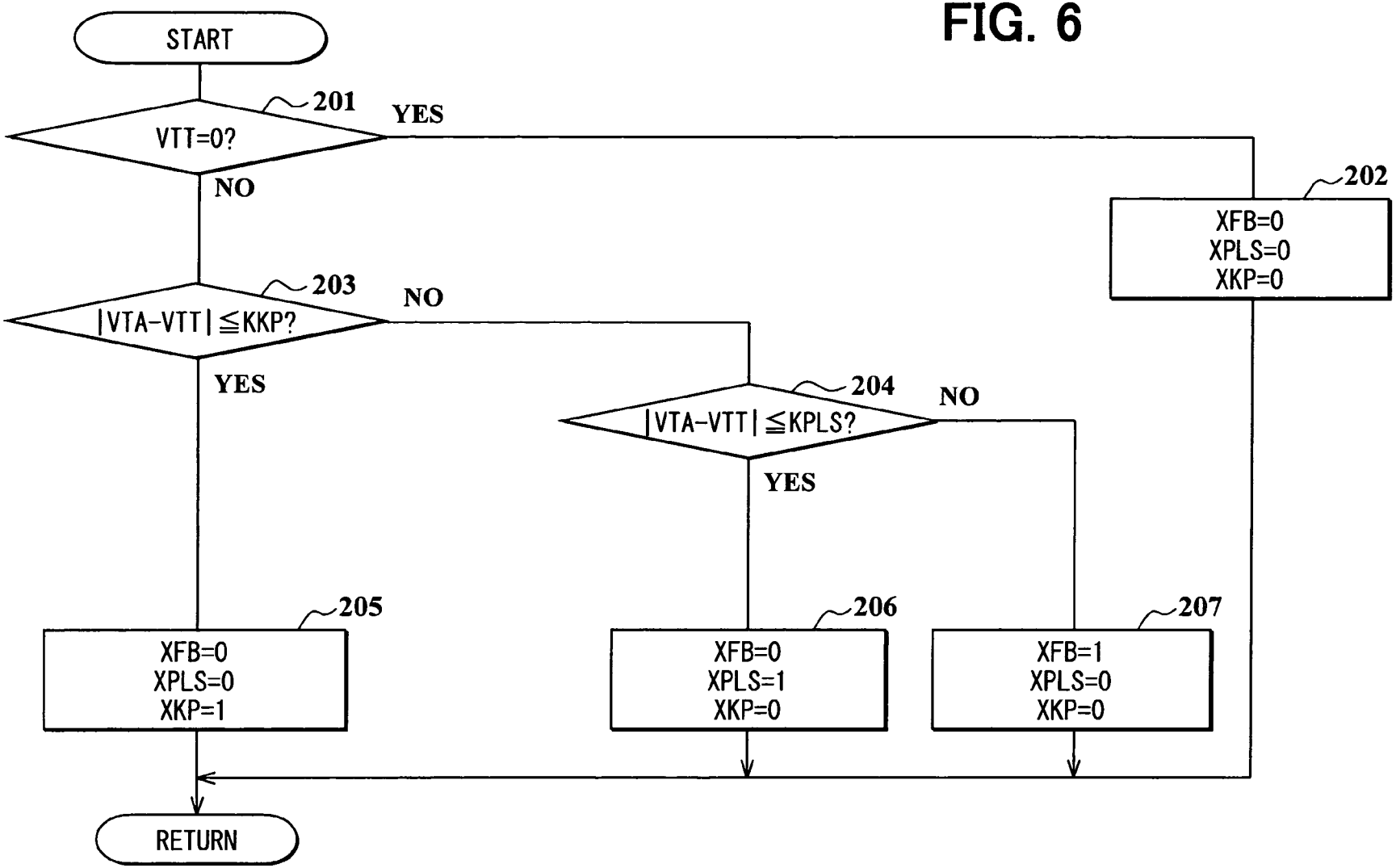
FIG. 6 is a flow chart explaining the process order of a VCT control mode determination routine.
Figure 7:
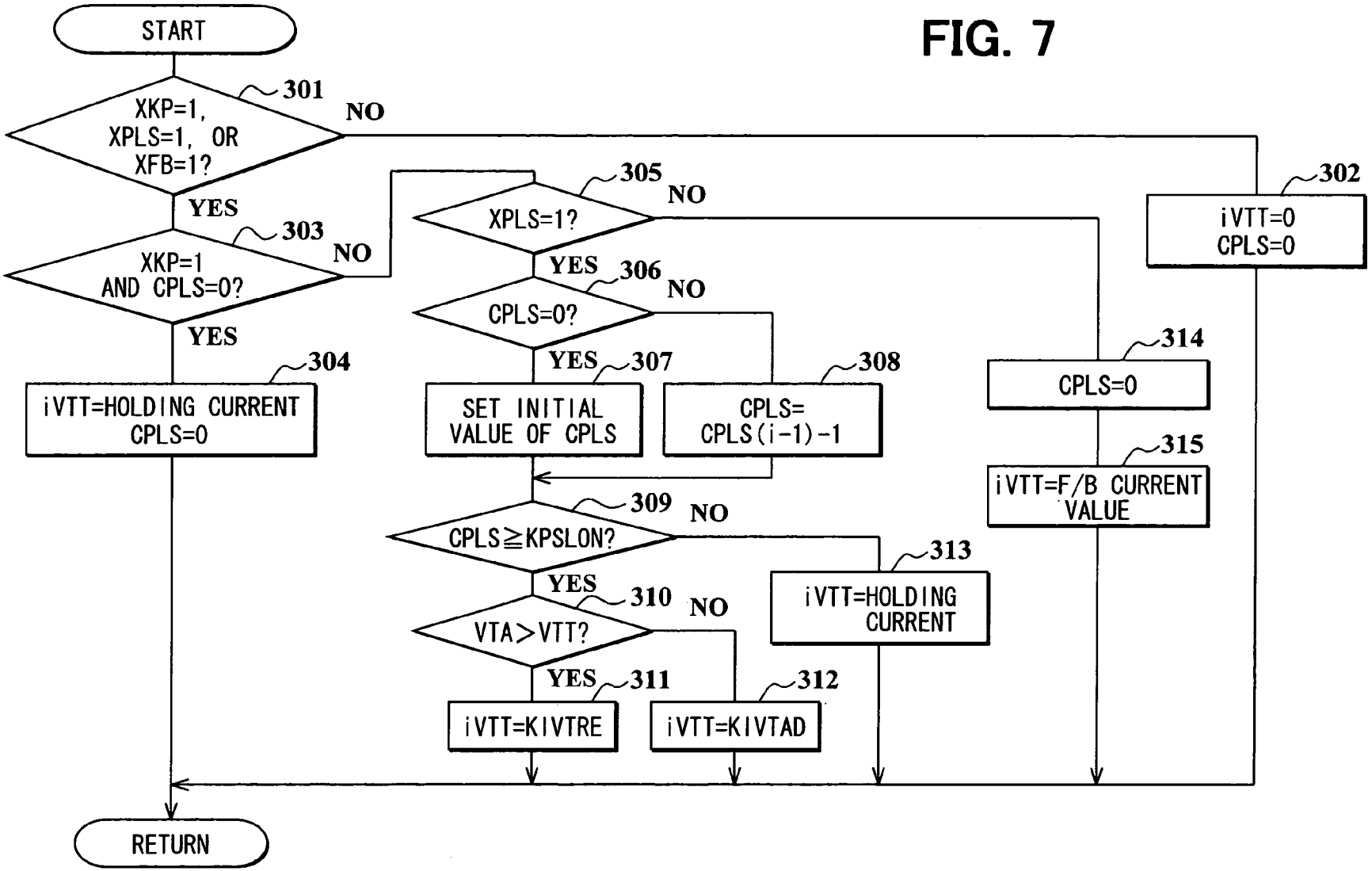
FIG. 7 is a flow chart explaining the process order of an OCV target current calculation routine.

The VCT control of the present embodiment described above is performed by the ECU 43 according to each of the routines shown in FIG. 5 to FIG. 7. The process content of each routine will be described below.

[VCT Control Routine]

A VCT control routine in FIG. 5 is executed in a predetermined cycle (for example, 5 ms cycle) during engine operation. At step 101 an operating condition (for example, engine rotational speed, load, cooling water temperature or the like) is detected. At the next step 102 it is determined whether or not the VCT control execution condition is met based upon the detected operating condition. As a result, when it is determined that the VCT control execution condition is not met, the present routine ends without execution of the subsequent process. In a case where the VCT control is not performed, a target advance amount VVT is maintained at zero (maximum retard position).

On the other hand, when it is determined at step 102 that the VCT control execution condition is met, the process goes to step 103, wherein an actual advance amount VTA (advance amount from the maximum retard amount to the present position) is calculated based upon a phase difference between an output signal of a crank angle sensor 44 and the subsequent output signal of a cam angle sensor 45. At the next step 104 a target advance amount VTT is calculated from a map or the like in accordance with the present operating condition (engine rotational speed, load or the like).

Thereafter, the process goes to step 105, wherein a VCT control mode determination routine in FIG. 6 to be described later is executed to determine whether the present VCT control mode is the holding control mode, the micro displacement control mode (pulse-current application control) or the high-speed control mode. After this, the process goes to step 106, wherein an OCV target current calculation routine in FIG. 7 to be described later is executed to calculate an OCV target current iVVT in accordance with the present VCT control mode. In addition, at the next step 107 a control duty is calculated for controlling a control current of the hydraulic control valve 21 (OCV) to the OCV target current iVVT, and the present routine ends.

[VCT Control Mode Determination Routine]

A VCT control mode determination routine in FIG. 6 is a subroutine executed at step 105 of the VCT control routine in FIG. 5. At step 201 it is determined whether or not the target advance amount VTT is zero (maximum retard position). When the target advance amount VTT is zero (maximum retard position), it is determined that the VCT control (high-speed control, micro displacement control, and holding control) is not performed and the process goes to step 202, wherein a high-speed control execution flag XFB, a micro displacement control execution flag XPLS and a holding control execution flag XKP are all cleared to zero and the present routine ends.

On the other hand, when it is determined at step 201 that the target advance amount VTT is not zero (maximum retard position), the process goes to step 203, wherein the absolute value |VTA−VTT| of the deviation between the actual advance amount VTA and the target advance amount VTT is compared with the determination threshold value KKP for the holding control region. When the absolute value |VTA−VTT| of the advance amount deviation is equal to or less than the determination threshold value KKP for the holding control region, it is determined that the present VCT control mode is the holding control mode. Then, the process goes to step 205, wherein the high-speed control execution flag XFB and the micro displacement control execution flag XPLS are cleared to zero and the holding control execution flag XKP alone is set to "1" and the present routine ends.

In contrast, at step 203, when the absolute value |VTA−VTT| of the advance amount deviation exceeds than the determination threshold value KKP for the holding control region, it is determined that the present VCT control mode is not the holding control mode. Then, the process goes to step 204, wherein the absolute value |VTA−VTT| of the advance amount deviation is compared with the determination threshold value KPLS for the micro displacement control region. When the absolute value |VTA−VTT| of the advance amount deviation is equal to or less than the determination threshold value KPLS for the micro displacement control region (i.e., KKP<|VTA−VTT|≦KPLS), it is determined that the present VCT control mode is the micro displacement control mode. Then, the process goes to step 206, wherein the high-speed control execution flag XFB and the holding control execution flag XKP are cleared to zero and the micro displacement control execution flag XPLS alone is set to "1" and the present routine ends.

At step 204, when the absolute value |VTA−VTT| of the advance amount deviation exceeds the determination threshold value KPLS for the micro displacement control region, it is determined that the present VCT control mode is the high-speed control mode. Then, the process goes to step 207, wherein the high-speed control execution flag XFB alone is set to "1" and the micro displacement control execution flag XPLS and the holding control execution flag XKP are cleared to zero and the present routine ends.

[OCV Target Current Calculation Routine]

An OCV target current calculation routine in FIG. 7 is a subroutine executed at step 106 of the VCT control routine in. FIG. 5. When the present routine is activated, first at step 301 it is determined whether or not the holding control execution flag XKP, the micro displacement control execution flag XPLS or the high-speed control execution flag XFB is set to "1". When all the flags are "0", it is determined that the VCT control (holding control, micro displacement control, high-speed control) is not performed and the process goes to step 302, wherein the OCV target current iVVT is maintained at zero (maximum retard position), and the pulse-current application time counter CPLS is cleared to zero, followed by the end of the present routine. It should be noted that the OCV target current iVVT in the maximum retard position may be a current value other than zero so long as the VCT 11 does not advance with the current.

On the other hand, when it is determined at step 301 that any flag is set to "1", the process goes to step 303, wherein it is determined whether or not the holding control execution flag XKP is set at "1" and the pulse-current application time counter CPLS is set at zero. When this result of the determination is "YES", the process goes to step 304, wherein the OCV target current iVVT is set to a holding current so as to execute the holding control, and also the pulse-current application time counter CPLS is maintained at zero. In this case, for the holding current, a value learned during the holding control may be used.

The holding current may be learned, for example, by repeating the process in which, if the event that the actual advance amount VTA goes beyond the holding control region in the advance direction occurs subsequently many times during the holding control, it is determined that the holding-current learned value exceeds a proper value in the advance direction and the holding-current learned value is corrected by a predetermined value in the retard direction, but if the event that the actual advance amount VTA goes beyond the holding control region in the retard direction occurs subsequently many times during, it is determined that the holding-current learned value exceeds a proper value in the retard direction and the holding-current learned value is corrected by a predetermined value in the advance direction. The holding-current learned value may be learned for each operating condition (hydraulic pressure, hydraulic temperature, or engine rotational speed, cooling-water temperature or the like which is information correlating with the hydraulic pressure or the hydraulic temperature) or for each region of the target advance amount VTT, and be stored and updated in a rewritable nonvolatile memory such as a backup RAM of the ECU 43.

On the other hand, when the result of the determination at step 303 is No, the determination not to execute the holding control is made. Then, the process goes to step 305, wherein it is determined whether or not the micro displacement control execution flag XPLS is set at "1". When the micro displacement control execution flag XPLS is "1", the micro displacement control (pulse-current application control) is performed as described below.

First, it is determined at step 306 whether or not the pulse-current application time counter CPLS is zero. When the pulse-current application time counter CPLS is zero, the process goes to step 307 to start the micro displacement control. At step 307, an initial value of the pulse-current application time counter CPLS is set according to the present operating condition (hydraulic pressure, hydraulic temperature, or engine rotational speed, cooling-water temperature or the like which is information correlating with the hydraulic pressure or the hydraulic temperature). The initial value of the pulse-current application time counter CPLS is for setting, according to the present operating condition, the pulse-current application time required for moving the actual advance amount VTA into the range in close proximity to the target advance amount VTT, and may be stored and updated in a rewritable nonvolatile memory of the ECU 43 after being learned for each operating condition.

If it is determined at step 306 that the pulse-current application time counter CPLS is not zero, it is determined that the VTC control is in the middle of executing the pulse-current application control, the process goes to step 308, wherein the pulse-current application time counter CPLS is decremented by one to measure the pulse-current application time.

Then, the process goes to step 309, wherein the counter value of the pulse-current application time counter CPLS is compared with a determining value KPSLON for terminating the pulse-current application control. When the counter value of the pulse-current application time counter CPLS is equal to or larger than the determining value KPSLON for terminating the pulse-current application control, it is determined that it is not time the pulse-current application control is terminated. The process goes to step 310, wherein it is determined from the magnitude relationship between the actual advance amount VTA and the target advance amount VTT whether the VCT 11 should be driven in the advance direction or the retard direction. At this point, if the actual advance amount VTA is larger than the target advance amount VTT, it is determined that the VCT 11 should be driven in the retard direction. Then, the process goes to step 311, wherein the OCV target current iVVT for the pulse application control is set to a retard-side set value KIVTRE to drive the VCT 11 in the retard direction. At this point, the retard-side set value KIVTRE may be set, for example, to a retard-side critical current value (OmA) or a current value close to the retard-side critical current value, or alternatively with reference to the holding current learned value (for example, to a current value which is lower by a predetermined value than the holding current learned value).

On the other hand, if the actual advance amount VTA is smaller than the target advance amount VTT, it is determined that the VCT 11 should be driven in the advance direction. Then, the process goes to step 312, wherein the OCV target current iVVT for the pulse-current application control is set to an advance-side set value KIVTAD to drive the VCT 11 in the advance direction. At this point, the advance-side set value KIVTAD may be set, for example, to an advance-side critical current value (OCV maximum tolerance current) or a current value close to it, or alternatively with reference to the holding current learned value (for example, to a current value which is larger by a predetermined value than the holding current learned value).

After that, at the time when the count value of the pulse-current application time counter CPLS has fallen below the determining value KPSLON for terminating the pulse-current application control (i.e., at the time when the result of the determination at step 309 is "No" for the first time), it is determined that it is time the pulse-current application control is terminated (time the holding control is restarted). The process goes to step 313, wherein the OCV target current iVVT is set to the holding current to start the holding control.

If the results of the determinations in both steps 303 and 305 are "No", it is determined that the present VCT control mode is the high-speed control mode (high-speed control execution flag XFB=1). The process goes to step 314, wherein the pulse-current application time counter CPLS is cleared to zero. At step 315 subsequent to step 314, the feedback control such as PD control is performed to set the OCV target current iVVT in accordance with the deviation between the actual displacement angle VTA of the VCT 11 and the target displacement angle VTT.

On this connection, the feedforward control may be performed to set the OCV target current iVVT in accordance with the deviation between the actual displacement angle VTA of the VCT 11 and the target displacement angle VTT. It is needless to say that a combination of the feedback control and the feedforward control may be used to set the OCV target current iVVT.

Figure 8:
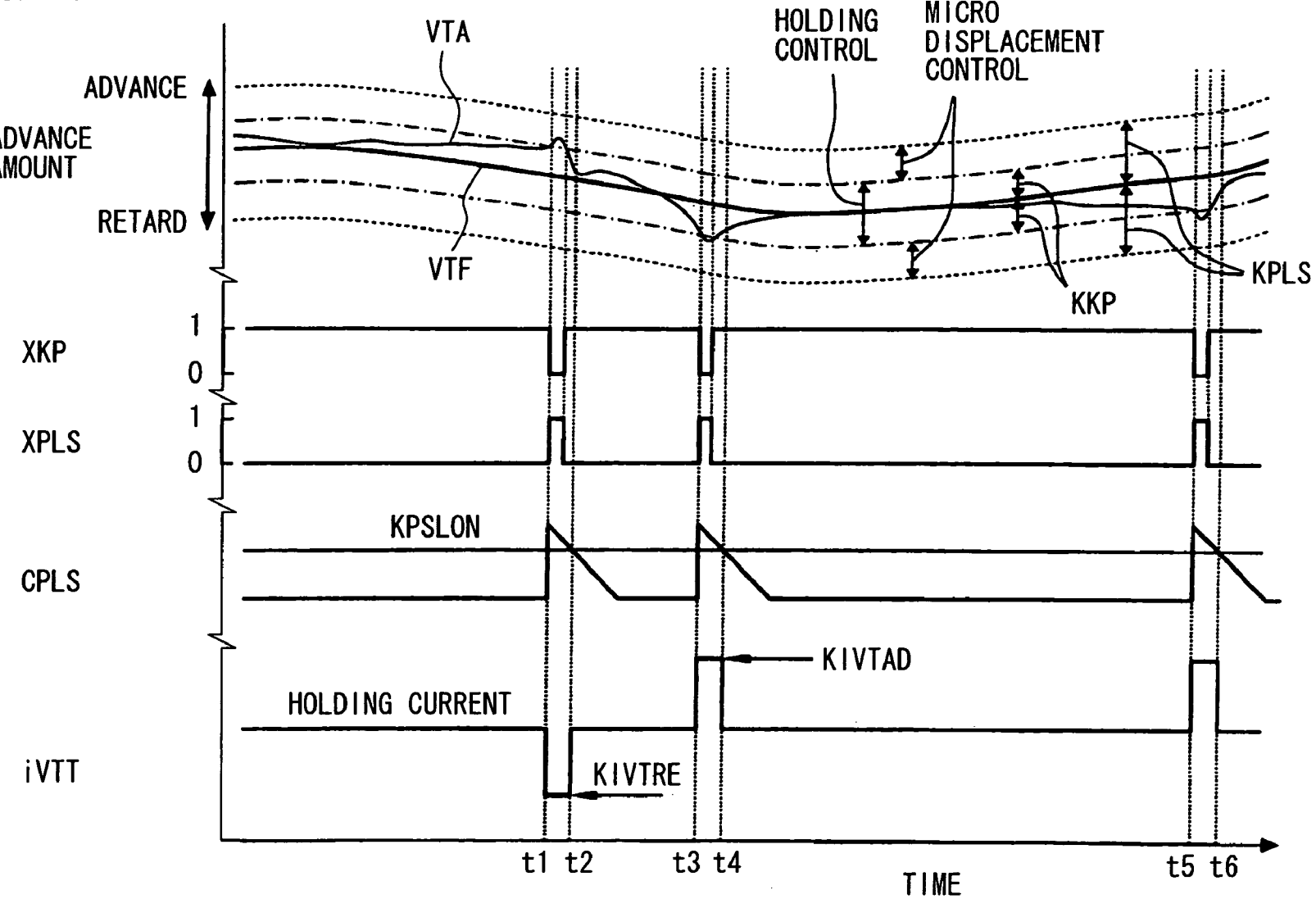
FIG. 8 is a time chart explaining an example of VCT control.

An example of the VCT control described in the foregoing embodiment is described with reference to the time chart in FIG. 8. The control example in FIG. 8 shows the control behavior when the deviation between the actual advance amount VTA and the target advance amount VTT reaches beyond the holding control region (determination threshold value KKP) while the holding control is being performed to hold the actual advance amount VTA in close proximity to the target advance amount VTT.

During the execution of the holding control, the OCV target current iVVT is set to the holding current to hold the actual advance amount VTA in close proximity to the target advance amount VTT. During the execution of the holding control, at times t1, t3, and t5 when the deviation between the actual advance amount VTA and the target advance amount VTT reaches beyond the holding control region (determination threshold value KKP) and enters into the micro displacement control region, the holding control execution flag XKP is switched from "1" to "0", followed by the termination of the holding control. Simultaneously, the micro displacement control execution flag XPLS is switched from "0" to "1" to start the micro displacement control (pulse-current application control).

In the micro displacement control (pulse-current application control), when the actual advance amount VTA reaches to a value by the determination threshold value KKP or more in the retard direction beyond the target advance amount VTT (t3 to t4, t5 to t6), the OCV target current iVVT is set to the advance-side set value KIVTAD to drive the VCT 11 in the advance direction. When the actual advance amount VTA reaches to a value by the determination threshold value KKP or more in the advance direction beyond the target advance amount VTT (t1 to t2), the OCV target current iVVT is set to the retard-side set value KIVTRE to drive the VCT 11 in the retard direction.

At the starting time of the micro displacement control (t1, t3, t5), an initial value of the pulse-current application time counter CPLS is set in accordance with the present operating condition (hydraulic pressure, hydraulic temperature, or engine rotational speed, cooling-water temperature or the like which is information correlating with the hydraulic pressure or the hydraulic temperature). Then, the count values of the pulse-current application time counter CPLS are decremented by every predetermined calculation cycles. At the time when the count value of the pulse-current application time counter CPLS falls below the determining value KPSLON for terminating the pulse-current application control (t2, t4, t6), it is determined that the actual advance amount VTA comes back in close proximity to the target advance amount VTT. Thus, the holding control is restarted and the OCV target current iVVT is set to the holding current to hold the actual advance amount VTA at the target advance amount VTT.

According to the aforementioned present embodiment, when the micro displacement control is performed to finely change the actual advance amount VTA of the VCT 11 in the range in close proximity to the target advance amount VTT, the pulse current is applied to the hydraulic control valve 21 to use the advantages of the pulse current to drive the VCT 11 in the direction of the target advance amount VTT. In consequence, it is possible to drive the VCT 11 with a faster response than conventional in the direction of the target advance amount VTT without the occurrence of overshooting.

It should be noted that the present embodiment describes the case where the pulse-current application time (pulse width) required for changing the actual advance amount VTA back into the range in close proximity to the target advance amount VTT by the pulse-current application control is set in accordance with the operating condition, but the number of pulse-current applications may be set in accordance with the operating condition.

In addition, in the present invention, it may be determined on the basis of the OCV target current iVVT whether or not the deviation is in the range where the response characteristic of the VCT 11 to the OCV current is decreased in speed (the range of a gentle grade of the change of the VCT response rate between the rapid changing point of the response on the retard side and the rapid changing point of the response on the advance side), and then when it is determined that the deviation is in the range where the response characteristic of the VCT 11 becomes slow, the micro displacement control (pulse-current application control) may be performed whenever the deviation between the actual advance amount VTA and the target advance amount VTT reaches beyond the holding control region (determination threshold value KKP).

It should be noted that in the present invention, the hydraulic switching valve 38 for switching the hydraulic pressure driving the drain switching valves 34 and 35 may be separated from the hydraulic control valve 21, but since in the present embodiment, the hydraulic switching valve 38 is integral with the hydraulic control valve 21, it has an advantage of being capable of satisfying requirements of reduction of the number of component parts, costs and downsizing.

Besides, the present invention can be carried out with various modifications within the spirit thereof, such as a proper modification of a structure of the variable valve timing adjusting mechanism 11.

Figure 9:
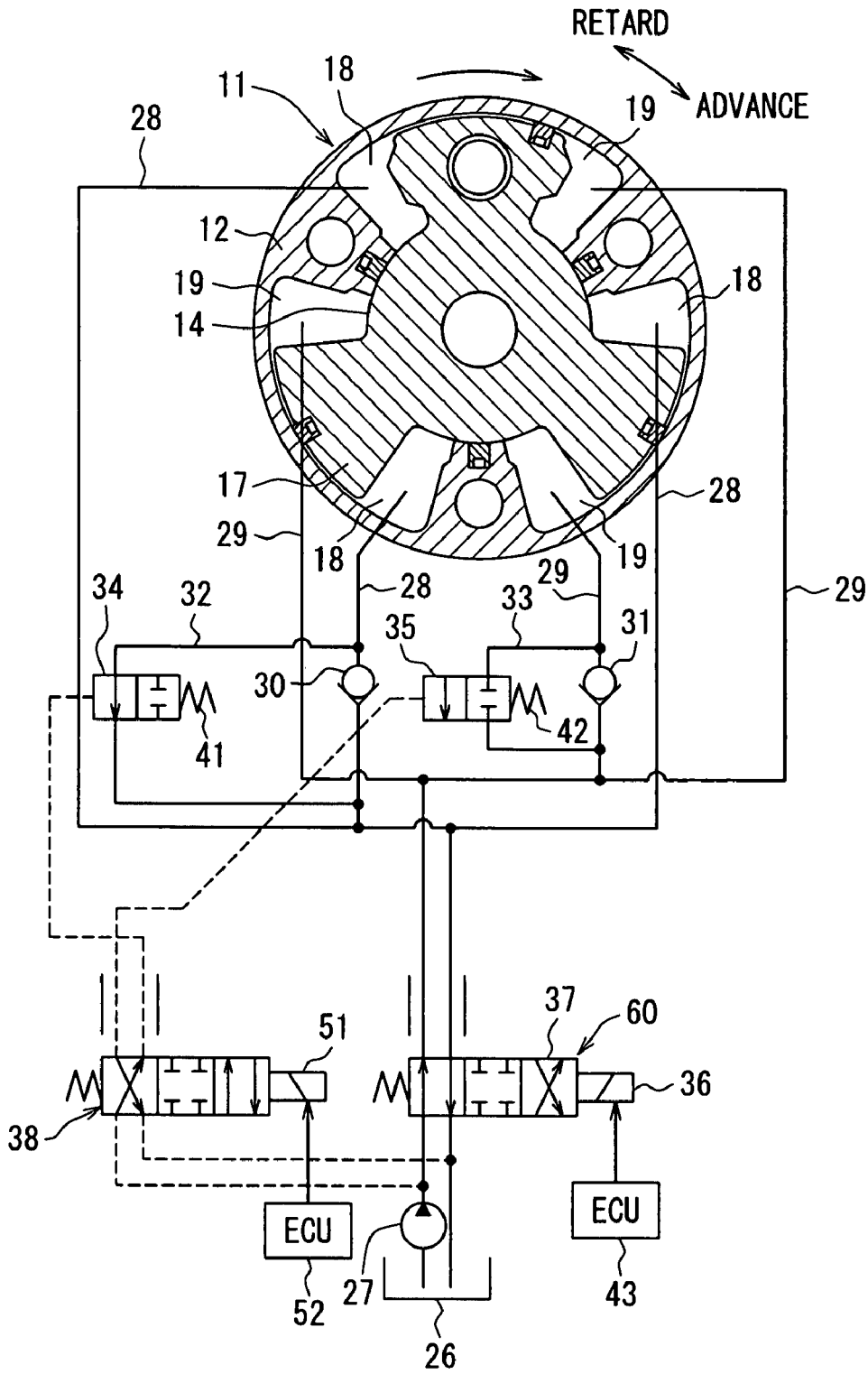
FIG. 9 is a schematic diagram showing a variable valve timing adjusting mechanism and a hydraulic control circuit thereof in another embodiment of the present invention.
Figure 10:
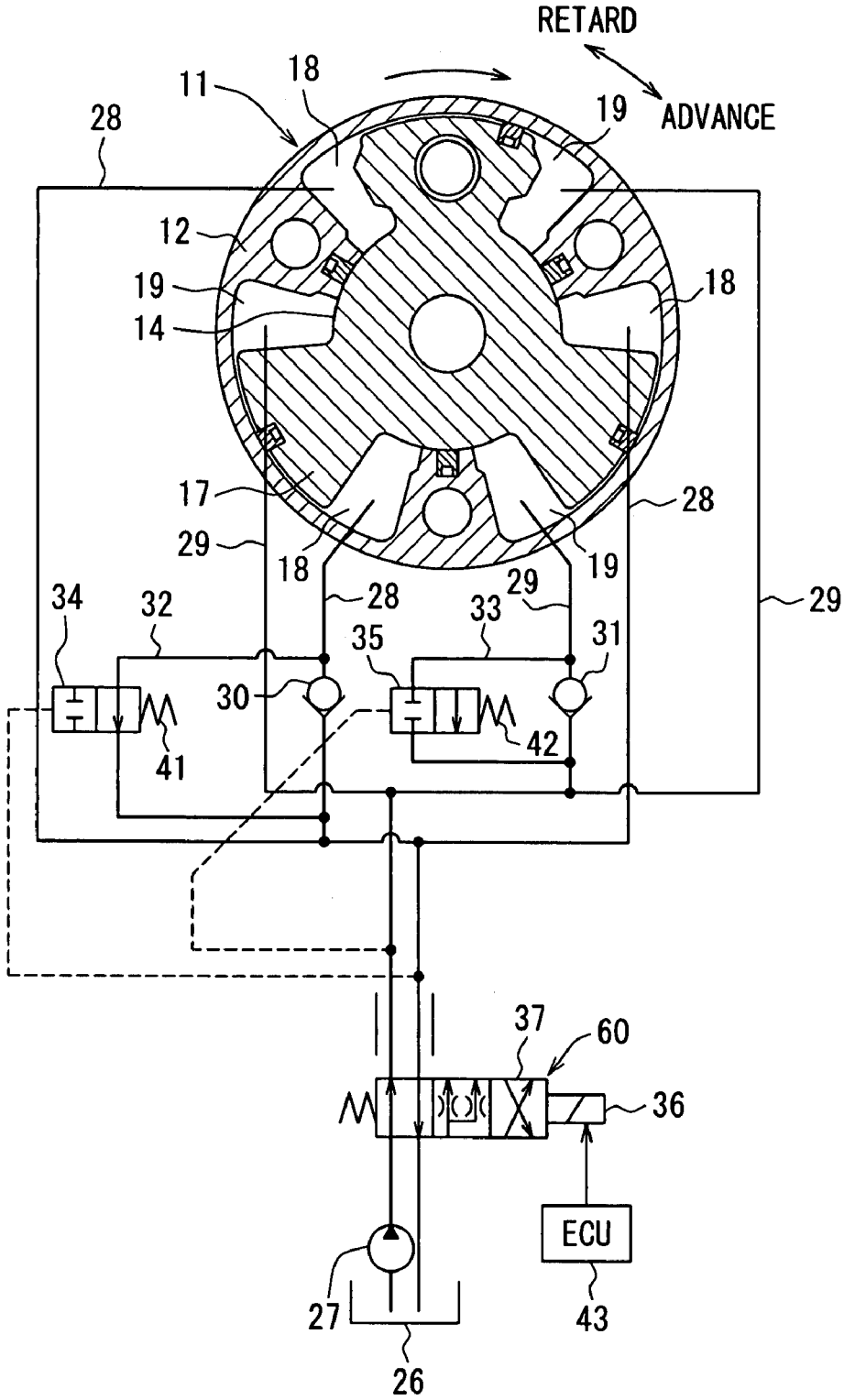
FIG. 10 is a schematic diagram showing a variable valve timing adjusting mechanism and a hydraulic control circuit thereof in a different embodiment of the present invention.

For example, in the above embodiment, the present invention is applied to the variable valve timing adjusting mechanism 11 shown in FIG. 1, but, not limited thereto, may be applied to a variable valve timing adjusting mechanism shown in FIG. 9 or 10, for example.

Components in FIGS. 9 and 10 identical to those in FIG. 1 are referred to like numbers.

First, the hydraulic control valve 21 in FIG. 1 drives the advance/retard hydraulic control valve 37 and the drain switching valve 38 by a single linear solenoid 36, but in a variable valve adjusting mechanism shown in FIG. 9, solenoids 36 and 51 are disposed in the advance/retard hydraulic control valve 37 and the drain switching valve 38 respectively and are respectively controlled by each of the ECUs 43 and 52.

The drain switching valves 34 and 35 shown in FIG. 1 are normally open-type switching valves, which are held in an open position by springs 41 and 42 when the hydraulic pressure is not applied to the drain switching valves 34 and 35. In contrast, in FIG. 9, when the hydraulic pressure is not applied to the drain switching valves 34 and 35, normally closed-type switching valves held in a closed open position by springs 41 and 42 are used as the drain switching valves 34 and 35. In consequence, the drain switching control function 38 is structured to supply the hydraulic pressure at the time of closing the drain switching valve, but in FIG. 9, is structured to stop the hydraulic pressure supply at the time of closing the drain switching valve.

In addition, in FIG. 1, the one-way valve and the drain switching valve are disposed in the hydraulic pressure supply passages corresponding to the advance hydraulic chamber and the retard hydraulic chamber in the single vane-accommodating chamber defined by a single vane, but in FIG. 9, the one-way valve and the drain switching valve are disposed in the hydraulic pressure supply passage corresponding to the advance hydraulic chamber in one vane-accommodating chamber and also in the hydraulic pressure supply passage corresponding to the retard hydraulic chamber in the other vane-accommodating chamber.

The present invention may be applied to the variable valve adjusting timing mechanism shown in FIG. 9 as described above.

In contrast, in FIG. 10, a single valve achieves an advance/retard hydraulic control function and a drain switching control function. For this reason, the hydraulic pressure supply passages 28 and 29 are branched between the hydraulic control valve and the one-way valve and are in communication with the drain switching valves 34 and 35 respectively.

What is claimed is:

1. A controller for a vane-type variable valve timing adjusting mechanism in which each of a plurality of vane accommodating chambers formed in a housing of the vane-type variable valve timing adjusting mechanism is divided into two chambers, an advance hydraulic chamber and a retard hydraulic chamber, by a vane, the controller comprising:

a hydraulic control valve for controlling a hydraulic pressure in the advance hydraulic chamber and a hydraulic pressure in the retard hydraulic chamber; and a control means for controlling an electric current applied to the hydraulic control valve in accordance with a deviation between a target displacement angle and an actual displacement angle of the variable valve timing adjusting mechanism, wherein:

the control means performs pulse-current application control to apply pulse current to the hydraulic control valve to drive the variable valve timing adjusting mechanism in a direction of a target displacement angle, and further comprising:

a one-way valve disposed in each of hydraulic supply passages of the advance hydraulic chamber and the retard hydraulic chamber in at least one of the vane accommodating chambers for preventing a reverse flow of operating oil from the hydraulic chamber;

a drain oil passage disposed in parallel to the hydraulic supply passage of each of the hydraulic chambers for bypassing the one-way valve;

a drain switching valve disposed in the drain oil passage and driven by a hydraulic pressure; and a hydraulic switching valve switching the hydraulic pressure to drive the drain switching valve, wherein:

when an advance operation of the variable valve timing adjusting mechanism is performed, the control means controls the hydraulic switching valve to close the drain switching valve for the advance hydraulic chamber into which the operating oil flows and to open the drain switching valve for the retard hydraulic chamber from which the operating oil is discharged; and when a retard operation of the variable valve timing adjusting mechanism is performed, the control means controls the hydraulic switching valve to close the drain switching valve for the retard hydraulic chamber into which the operating oil flows and to open the drain switching valve for the advance hydraulic chamber from which the operating oil is discharged.

2. A controller for a vane-type variable valve timing adjusting mechanism according to claim 1, wherein:

the control means performs the pulse-current application control in a control region where a response characteristic of the variable valve timing adjusting mechanism to an electric current of the hydraulic control valve decreases in speed.

3. A controller for a vane-type variable valve timing adjusting mechanism according to claim 1, wherein:

the control means performs the pulse-current application control in a micro displacement control region where the actual displacement angle of the variable valve timing adjusting mechanism is finely changed for micro displacement in close proximity to the target displacement angle.

4. A controller for a vane-type variable valve timing adjusting mechanism according to claim 3, wherein:

the control means defines, as a holding control region, a region where the deviation between the target displacement angle and the actual displacement angle of the variable valve timing adjusting mechanism is smaller than a determination threshold value of the deviation in the micro displacement control region, and applies a holding current to the hydraulic control valve to hold the actual displacement angle of the variable valve timing adjusting mechanism at the target displacement angle in the holding control region.

5. A controller for a vane-type variable valve timing adjusting mechanism according to claim 3, wherein:

the control means defines, as a high-speed control region, a region where the deviation between the target displacement angle and the actual displacement angle of the variable valve timing adjusting mechanism is larger than a determination threshold value of the deviation in the micro displacement control region, and performs a feedback control and/or a feedforward control on an electric current of the hydraulic control valve in accordance with the deviation between the target displacement angle and the actual displacement angle of the variable valve timing adjusting mechanism in the high-speed control region.

6. A controller for a vane-type variable valve timing adjusting mechanism according to claim 1, wherein:

the control means varies either an application time-period or the number of applications of the pulse current to control a displacement amount of the variable valve timing adjusting mechanism.

7. A controller for a vane-type variable valve timing adjusting mechanism according to claim 6, wherein:

the control means learns a relationship between either the application time-period or the number of applications of the pulse current and the displacement amount of the variable valve timing adjusting mechanism driven by the application of the pulse current, and sets either the application time-period or the number of applications of the pulse current on the basis of a learned value obtained from the learning.

8. A controller for a vane-type variable valve timing adjusting mechanism according to claim 7, wherein:

the control means learns the learned value for each operating condition.

9. A controller for a vane-type variable valve timing adjusting mechanism in which each of a plurality of vane accommodating chambers formed in a housing of the vane-type variable valve timing adjusting mechanism is divided into two chambers, an advance hydraulic chamber and a retard hydraulic chamber, by a vane, the controller comprising:

a hydraulic control valve for controlling a hydraulic pressure in the advance hydraulic chamber and a hydraulic pressure in the retard hydraulic chamber; and a control means for controlling an electric current applied to the hydraulic control valve in accordance with a deviation between a target displacement angle and an actual displacement angle of the variable valve timing adjusting mechanism, wherein:

the control means performs pulse-current application control to apply pulse current to the hydraulic control valve to drive the variable valve timing adjusting mechanism in a direction of a target displacement angle, and further comprising:

a first one-way valve disposed in a hydraulic supply passage of the advance hydraulic chamber in at least one of the vane accommodating chambers for preventing a reverse flow of operating oil from the advance hydraulic chamber;

a first drain control valve disposed in a first drain oil passage bypassing the first one-way valve and driven by a hydraulic pressure;

a second one-way valve disposed in a hydraulic supply passage of the retard hydraulic chamber in at least one of the vane accommodating chambers for preventing a reverse flow of operating oil from the retard hydraulic chamber;

a second drain control valve disposed in a second drain oil passage bypassing the second one-way valve and driven by the hydraulic pressure;

a first hydraulic control valve for controlling the hydraulic pressure in the advance hydraulic chamber and the hydraulic pressure in the retard hydraulic chamber; and a second hydraulic control valve for controlling the hydraulic pressure driving the first and second drain control valves, wherein:

when an advance operation of the variable valve timing adjusting mechanism is performed, the control means controls the second hydraulic control valve to close the drain control valve for the advance hydraulic chamber into which the operating oil flows and to open the drain control valve for the retard hydraulic chamber from which the operating oil is discharged; and when a retard operation of the variable valve timing adjusting mechanism is performed, the control means controls the second hydraulic control valve to close the drain control valve for the retard hydraulic chamber into which the operating oil flows and to open the drain control valve for the advance hydraulic chamber from which the operating oil is discharged.

10. A controller for a vane-type variable valve timing adjusting mechanism according to claim 9, wherein:

the hydraulic control valve and the second hydraulic control valve are constructed to be independently controllable; and the control means includes first control means for controlling an electric current of the first hydraulic control valve in accordance with the deviation between the target displacement angle and the actual displacement angle of the variable valve timing adjusting mechanism, and second control means for controlling an electric current of the second hydraulic control valve to control the hydraulic pressure driving each of the drain control valves.

11. A controller for a vane-type variable valve timing adjusting mechanism according to claim 9, wherein the first hydraulic control valve and the second hydraulic control valve are driven by shafts structured integrally with each other; and the control means controls an electric current of the hydraulic control valve to control the hydraulic control valve in accordance with the deviation between the target displacement angle and the actual displacement angle of the variable valve timing adjusting mechanism, and also controls the second hydraulic control valve to control the hydraulic pressure driving each of the drain control valves.

12. A controller for a vane-type variable valve timing adjusting mechanism according to claim 9, wherein:

the control means performs the pulse-current application control in a control region where a response characteristic of the variable valve timing adjusting mechanism to an electric current of the hydraulic control valve decreases in speed.

13. A controller for a vane-type variable valve timing adjusting mechanism according to claim 12, wherein:

the control means performs the pulse-current application control in a micro displacement control region where the actual displacement angle of the variable valve timing adjusting mechanism is finely changed for micro displacement in close proximity to the target displacement angle.

14. A controller for a vane-type variable valve timing adjusting mechanism according to claim 13, wherein:

the control means defines, as a holding control region, a region where the deviation between the target displacement angle and the actual displacement angle of the variable valve timing adjusting mechanism is smaller than a determination threshold value of the deviation in the micro displacement control region, and applies a holding current to the hydraulic control valve to hold the actual displacement angle of the variable valve timing adjusting mechanism at the target displacement angle in the holding control region.

15. A controller for a vane-type variable valve timing adjusting mechanism according to claim 13, wherein:

the control means defines, as a high-speed control region, a region where the deviation between the target displacement angle and the actual displacement angle of the variable valve timing adjusting mechanism is larger than a determination threshold value of the deviation in the micro displacement control region, and performs a feedback control and/or a feedforward control on an electric current of the hydraulic control valve in accordance with the deviation between the target displacement angle and the actual displacement angle of the variable valve timing adjusting mechanism in the high-speed control region.

16. A controller for a vane-type variable valve timing adjusting mechanism according to claim 9, wherein:

the control means varies either an application time-period or the number of applications of the pulse current to control a displacement amount of the variable valve timing adjusting mechanism.

17. A controller for a vane-type variable valve timing adjusting mechanism in which each of a plurality of vane accommodating chambers formed in a housing of the vane-type variable valve timing adjusting mechanism is divided into two chambers, an advance hydraulic chamber and a retard hydraulic chamber, by a vane, the controller comprising:

a hydraulic control valve for controlling a hydraulic pressure in the advance hydraulic chamber and a hydraulic pressure in the retard hydraulic chamber; and a control means for controlling an electric current applied to the hydraulic control valve in accordance with a deviation between a target displacement angle and an actual displacement angle of the variable valve timing adjusting mechanism, wherein:

the control means performs pulse-current application control to apply pulse current to the hydraulic control valve to drive the variable valve timing adjusting mechanism in a direction of a target displacement angle, and further comprising:

a first one-way valve disposed in a hydraulic supply passage of the advance hydraulic chamber in at least one of the vane accommodating chambers for preventing a reverse flow of operating oil from the advance hydraulic chamber;

a first drain oil passage bypassing the first one-way valve;

a second one-way valve disposed in a hydraulic supply passage of the retard hydraulic chamber in at least one of the vane accommodating chambers for preventing a reverse flow of operating oil from the retard hydraulic chamber; and a second drain oil passage bypassing the second one-way valve, wherein:

the hydraulic control valve is provided integrally with a drain oil passage control function of opening/blocking the first drain oil passage and the second drain oil passage; and when an advance operation of the variable valve timing adjusting mechanism is performed, the control means controls the hydraulic control valve to block the drain oil passage for the advance hydraulic chamber into which the operating oil flows and to open the drain oil passage for the retard hydraulic chamber from which the operating oil is discharged, and when a retard operation of the variable valve timing adjusting mechanism is performed, the control means controls the hydraulic control valve to block the drain oil passage for the retard hydraulic chamber into which the operating oil flows and to open the drain oil passage for the advance hydraulic chamber from which the operating oil is discharged.

18. A controller for a vane-type variable valve timing adjusting mechanism according to claim 17, further comprising:

a first drain control valve disposed in the first drain oil passage and driven by hydraulic pressure, and a second drain control valve disposed in the second drain oil passage and driven by hydraulic pressure, wherein:

the drain oil passage control function of the hydraulic control valve performs hydraulic control to open/close the first drain control valve to open/block the first drain oil passage, and to open/close the second drain control valve to open/block the second drain oil passage.

19. A controller for a vane-type variable valve timing adjusting mechanism according to claim 17, wherein:

the control means performs the pulse-current application control in a control region where a response characteristic of the variable valve timing adjusting mechanism to an electric current of the hydraulic control valve decreases in speed.

20. A controller for a vane-type variable valve timing adjusting mechanism according to claim 19, wherein:

the control means performs the pulse-current application control in a micro displacement control region where the actual displacement angle of the variable valve timing adjusting mechanism is finely changed for micro displacement in close proximity to the target displacement angle.

21. A controller for a vane-type variable valve timing adjusting mechanism according to claim 20, wherein:

the control means defines, as a holding control region, a region where the deviation between the target displacement angle and the actual displacement angle of the variable valve timing adjusting mechanism is smaller than a determination threshold value of the deviation in the micro displacement control region, and applies a holding current to the hydraulic control valve to hold the actual displacement angle of the variable valve timing adjusting mechanism at the target displacement angle in the holding control region.

22. A controller for a vane-type variable valve timing adjusting mechanism according to claim 20, wherein:

the control means defines, as a high-speed control region, a region where the deviation between the target displacement angle and the actual displacement angle of the variable valve timing adjusting mechanism is larger than a determination threshold value of the deviation in the micro displacement control region, and performs a feedback control and/or a feedforward control on an electric current of the hydraulic control valve in accordance with the deviation between the target displacement angle and the actual displacement angle of the variable valve timing adjusting mechanism in the high-speed control region.

23. A controller for a vane-type variable valve timing adjusting mechanism according to claim 17, wherein:

the control means varies either an application time-period or the number of applications of the pulse current to control a displacement amount of the variable valve timing adjusting mechanism.

* * * * *